US007007417B2

(12) United States Patent
Segan et al.

(10) Patent No.: US 7,007,417 B2
(45) Date of Patent: Mar. 7, 2006

(54) AUDIO-VISUAL DISPLAY DEVICE FOR PICTORIAL ARTWORK

(75) Inventors: Marc H. Segan, New York, NY (US); Richard Awad, New York, NY (US)

(73) Assignee: M.H. Segan Limited Partnership, Great Barrington, MA (US)

( * ) Notice: Subject to any disclaimer, the term of this patent is extended or adjusted under 35 U.S.C. 154(b) by 408 days.

(21) Appl. No.: 10/348,307

(22) Filed: Jan. 21, 2003

(65) Prior Publication Data

US 2003/0168984 A1 Sep. 11, 2003

Related U.S. Application Data

(60) Provisional application No. 60/350,226, filed on Jan. 18, 2002.

(51) Int. Cl.
*G09F 13/00* (2006.01)
*A47G 1/06* (2006.01)
*H05B 41/36* (2006.01)

(52) U.S. Cl. ..... 40/444; 40/714; 40/716; 40/717; 315/307

(58) Field of Classification Search ..... 315/1, 315/149, 312, 324, 307; 40/442, 575, 716, 40/717, 124.02, 124.03, 427, 444, 463, 714; 434/317; 345/87
See application file for complete search history.

(56) References Cited

U.S. PATENT DOCUMENTS

| | | | | |
|---|---|---|---|---|
| 1,683,263 | A | 9/1928 | Ruckelshaus | |
| 3,604,707 | A | 9/1971 | Hurley | 273/85 R |
| 3,651,586 | A | 3/1972 | Funk | 35/45 |
| 3,688,008 | A | 8/1972 | Krieger, Sr. | 35/17 |
| 3,745,678 | A | 7/1973 | Thomassen | 40/106.52 |
| 4,299,041 | A | 11/1981 | Wilson | 40/124.1 |
| 4,853,678 | A | 8/1989 | Bishop et al. | 340/573 |
| 5,228,879 | A | 7/1993 | Fromm | 446/219 |
| 5,657,004 | A | 8/1997 | Whittaker et al. | 340/815.45 |
| 5,664,352 | A * | 9/1997 | Beckman | 40/545 |
| 5,720,480 | A * | 2/1998 | Lawlor et al. | 273/118 A |
| 5,841,496 | A * | 11/1998 | Itoh et al. | 349/113 |
| 5,971,827 | A * | 10/1999 | Lee et al. | 446/81 |
| 6,452,577 | B1 * | 9/2002 | Gale et al. | 345/87 |
| 6,816,679 | B1 * | 11/2004 | Lemelson et al. | 396/312 |
| 6,823,618 | B1 * | 11/2004 | Huang | 40/575 |
| 2002/0000057 | A1 * | 1/2002 | Nash | 40/564 |
| 2002/0009701 | A1 * | 1/2002 | Greenberg | 434/317 |
| 2002/0113555 | A1 * | 8/2002 | Lys et al. | 315/149 |
| 2002/0133993 | A1 * | 9/2002 | Mueller | 40/714 |
| 2003/0037472 | A1 * | 2/2003 | Nolan | 40/574 |
| 2003/0046847 | A1 * | 3/2003 | Yoshida | 40/717 |
| 2003/0064892 | A1 * | 4/2003 | Georges | 503/227 |
| 2004/0077264 | A1 * | 4/2004 | Walker et al. | 446/175 |
| 2004/0177540 | A1 * | 9/2004 | Abron | 40/577 |

* cited by examiner

*Primary Examiner*—Wilson Lee
*Assistant Examiner*—Angela M Lie
(74) *Attorney, Agent, or Firm*—Cohen, Pontani, Lieberman & Pavane

(57) ABSTRACT

An audio-visual display device for pictorial artwork is disclosed. The preferred embodiment has a universal back-box which contains a lightboard capable of lighting up any and/or all sections of a pictorial artwork placed above it, a hidden electric eye for detecting when the viewer wishes to see a snippet of an audio-visual sequence, a speaker, a memory for storing snippets of an audio sequence, and a microprocessor which receives signals from the electric eye and controls the speaker and the lightboard in accordance with an audio-visual sequence which brings to life the pictorial artwork.

52 Claims, 8 Drawing Sheets

AUDIO-VISUAL DISPLAY DEVICE FOR PICTORIAL ARTWORK

RELATED APPLICATIONS

This application claims priority from U.S. Provisional Patent Application Ser. No. 60/350,226 which was filed on Jan. 18, 2002 and which is hereby incorporated in its entirety.

BACKGROUND OF THE INVENTION

1. Field of the Invention

The present invention relates to display devices in general, and in particular to an electronically controlled and illuminated pictorial artwork display.

2. Description of the Related Art

Cartoon art displays suitable for hanging on a wall can range from simple frames for cartoon cels to complex devices with mechanical parts for moving the images of cartoon characters, speakers for playing back an audio soundtrack, and buttons for initiating the character movement with a synchronized audio soundtrack.

The more complex displays are much more valuable and much more difficult to manufacture. Such a display has a certain thickness within which the display objects may be placed at different depths so as to create a three-dimensional effect. There is a cartoon character (for example) on one piece in the center, with scenery artwork both in front of and in back of, the character. All of this production art is printed on the separate pieces. When a button in the bottom right-hand side is pushed, a sequence of movements with synchronized audio is initiated. The central cartoon character's body and arms move while the soundtrack with both music and dialogue from a movie is played. Other characters and moving objects may appear from behind scenery artwork during the sequence and execute their own movements.

Clearly, the parts of this display must be painstakingly crafted, joined together, and calibrated in order to insure that the sequence of movements and sounds will look and sound as it should. Most of the parts of this display, including the backbox and frame, are customized for this particular cartoon piece and cannot be used in the creation of other cartoon art displays. Because of the economies of scale, a large quantity of such displays (as many as 10,000) must be built in order to recoup fixed costs.

The complex nature of this type of audio-visual cartoon art display results in some shortcomings in both its manufacturing and retailing. As mentioned above, a large number of them must be produced so a truly limited edition of the display (perhaps 1,000) is not practicable from the manufacturing standpoint. Furthermore, because many of the parts, such as the mechanical actuators, are individually crafted and programmed for each style, the manufacturer can not take advantage of interchangeable parts which can be used in a multitude of display design styles.

Because of its complexity, this type of audio-visual cartoon art display must arrive at the retailers fully assembled in a frame. Thus, individual retailers can not individualize the display by placing their own frame on it, or by allowing the customer to choose a frame design. Furthermore, after pressing the button, sales people trying to show the audio-visual cartoon display must wait for the sequence of movements and audio to end before continuing the conversation with the customer. Because the sequence can last a considerable amount of time (e.g., 30 to 60 seconds), it can slow down the momentum of a sales pitch and otherwise distract from the salesperson's talking points. Moreover, if the salesperson is attempting to demonstrate several different styles of products, it becomes burdensome to listen to the audio-visual sequences of each style of product to its completion.

Furthermore, although these complex mechanical devices add audio and visual effects to cartoon art, the addition of these effects are a step removed from the traditional flat animation artworks. In other words, the large bulky mechanical displays are their own form of artwork, but not a means of adding more expressive value to traditional flat animation artworks. Further still, the fact that such a complex display has many mechanical parts makes it difficult to offer a variety of styles and programming.

Therefore, there is a need for a display device for traditional flat animation art which is capable of audio and visual effects which add value and expressive content to the artwork, without detracting from the traditional format of the artwork. There is also a need for an audio-visual cartoon art display device which allows the use of interchangeable parts while still retaining the integrity of traditional animation art. There is a further need for an audio-visual cartoon art display device that allows for the retailer or customer to individualize the framing of the display device without requiring the retailer or customer to deal with the complexities of the device. Furthermore, these is a need for an audio-visual cartoon art display device that may include a long soundtrack and sequence, yet doesn't require the entire sequence/soundtrack to play all the way through. Further still, there is a need for an audio-visual cartoon art display device that offers both reliability and a low service requirement.

SUMMARY OF THE INVENTION

One object of the present invention is to bring to life traditional flat animation art in an audio-visual display device without the manufacturing, retailing, and customization limitations of prior art mechanical display devices.

Another object of the present invention is to bring to life traditional flat animation art in an audio-visual display device without the service requirements and fragility of prior art mechanical display devices.

Another object of the present invention is to present traditional flat animation art in an audio-visual display device such that the traditional flat animation art appears to remain in its original flat format, rather than being altered to fit the audio or visual functions of the display device.

Another object of the present invention is to provide an audio-visual pictorial art display device which has interchangeable parts capable of being used with a variety of artworks.

Yet another object of the present invention is to provide an audio-visual cartoon art display device which allows retailers, framers, or customers to provide their own framework without requiring them to de-assemble or re-assemble the architecture or electronics of the display device.

Still another object of the present invention is to provide an audio-visual cartoon art display device that stores a long soundtrack and illumination sequence, yet doesn't require the entire sequence/soundtrack to play all the way through.

These and other objects are accomplished by the present invention which provides a display device with a universal backbox which has a lightboard capable of lighting up any and/or all sections of a pictorial artwork placed above it, a hidden electric eye for detecting when the viewer wishes to see a snippet of an audio-visual sequence, a speaker, a memory for storing snippets of an audio sequence, and a microprocessor which receives signals from the electric eye and controls the speaker and the lightboard in accordance with an audio-visual sequence.

One advantage of the present invention is the flexibility of the universal backbox—it is made largely of interchangeable parts, yet it forms part of an audio-visual cartoon art display device that is tailored to one unique piece of cartoon art. Only the soundtrack and the programming of the microprocessor need to be uniquely set to the particular cartoon artwork. Because of this, the manufacturer can build many universal backboxes and leave an inventory of them on hand. This is in contrast to the prior art, where many of the parts were uniquely built for a particular cartoon display device and therefore must be used for that display device or discarded.

Another advantage of the present invention is the capability of retailers, framers, or customers to provide their own unique framing. Because of the novel construction of the universal backbox, a person can use standard framing techniques on the display device without worrying about the complex architecture and electronics inside. This is also advantageous for smaller retailers that want to distinguish their product from large corporate retailers because the smaller retailer may create a uniquely framed product whereas the large corporate retailer may only offer one or two frame styles. Also advantageous is the fact that there are no user-serviceable parts in the finished audio-visual cartoon art display device, except perhaps the battery which can be replaced by opening a small door on the back of the backbox.

Another advantage of the present invention is the activation mechanism. Unlike the prior art, which uses a button placed conspicuously on the frame of the display device, the audio-visual cartoon art display device according to the present invention has no button, but an electric eye which "sees" when a viewer's hand passes close to a certain section of the display surface of the display device. This electric eye is hidden from view by the artwork itself, so that it does not detract from the artwork. Furthermore, it does not encroach upon the frame nor require a framer to work around it (or do any additional work to conform the frame so that the electric eye will "see")

Another advantage of the present invention is that the soundtrack and lighting effects can be broken down into "snippets", or smaller discrete units. These snippets can be as long or short as desired, and an individual artwork may have many snippets of varying or equal length. This allows the viewer to determine how much of the complete audio-visual track he or she will watch. It also makes it easier for salespeople to show the audio-visual effects of the display device quickly and efficiently, without being hampered by a long audio-visual sequence, such as exists in the prior art. Furthermore, the audio-visual track may run in a definite order or be randomized. In addition, the preferred embodiment will automatically play a sequence of snippets if the viewer keeps his or her hand close to the activation mechanism for over a set period of time. Thus, the viewer can enjoy larger segments (or possibly all) of the entire audio-visual sequence without continually reactivating the mechanism. The use of snippets increases the variety of possible styles and expressiveness of the artwork. For instance, a particular snippet may play very rarely, thus causing surprise when it finally does play. Furthermore, such an occasional snippet may be coordinated with lighting up a section of the artwork that is otherwise not visible to the viewer, thus adding to the surprise.

Yet another advantage of the present invention is the mutable nature of the lightboard. The lightboard is constructed as a reflector comprised of many bowl-shaped sockets, where each socket has a light emitting diode (LED) in the center. The light sockets may take any shape (e.g. an oval, a circle, or a polygon) in the plane of the surface of the lightboard. In the preferred embodiment, the lightboard is constructed as a honeycomb reflector comprised of many hexagonal bowl-shaped sockets. The hexagons function as "macro-pixels" which are turned on and off by the microprocessor according to the audio-visual sequence. Because the macro-pixels are evenly distributed (except for the center in the preferred embodiment), the cartoon artwork may have characters or objects which need to be lit up located anywhere on the sheet. All that is required is for the microprocessor to be programmed to light up the correct group of macro-pixels (in conjunction with playing the corresponding soundtrack). Further, the preferred embodiment uses LEDs which emit a monochromatic light with a narrow spectrum which is easily differentiable from the ambient white light lighting the display from the outside. This more effectively distinguishes the lit up section of the artwork, providing emphasis through the color change. In addition, the LEDs used in the preferred embodiment last much longer than standard bulbs.

A further advantage is the size of the inventive audio-visual display device in comparison to the prior art mechanical devices. The inventive audio-visual display device is much slimmer that the prior art mechanical devices, so that it does not jut out from the wall to which it is attached as the prior art mechanical devices do. This lends to a more harmonious appearance, especially with standard gallery framing.

A still further advantage is the more expressive nature of the inventive audio-visual display device in comparison to the prior art. Because the audio and visual effects of the display are tailored closely to the traditional animation art which is being displayed, the artwork is greatly enhanced in expression. Because the display can accommodate a large variety of artworks and snippet configurations, it is far more capable of extremely individualized artistic expression than the prior art. This is particularly true in relation to the snippets, because they may vary in length, arrangement, repetitive basis, etc.

These and other advantages, objects, and features of the present invention will become apparent from the following detailed description considered in conjunction with the accompanying drawings, photographs, and appendix. It is to be understood, however, that the drawings, photographs, and appendix are designed solely for purposes of illustration and not as a definition of the limits of the invention. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

The preferred embodiment of the present invention is a generic housing containing electronics, lights, speaker, switches, and structural lighting support. This housing is designed so that only the artwork and the programming of a microprocessor embedded in the housing need to be changed to produce a different style, movement, or image. Because of the layered construction of the housing, any artwork of the appropriate size may be placed within the display device and the microprocessor can be programmed to play a matching audio-visual track. In one embodiment, the programming is contained in a separate memory chip from the microprocessor so that the programming can be changed by replacing the memory chip. This could be accomplished through a special cover on the back of the unit, or through the cover for the battery compartment of the housing. In another embodiment, the microprocessor is permanently secured in the housing and could be re-programmed by a communication link with an exterior device.

Figure 1:
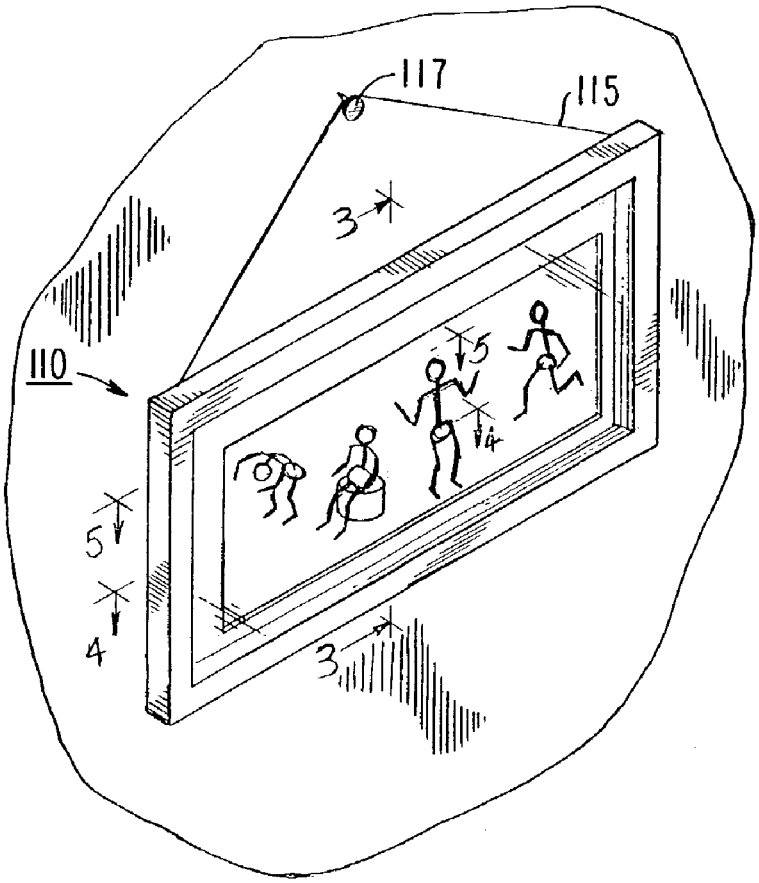
FIG. 1 is a perspective view of a display device according to a preferred embodiment of the present invention hanging on a vertical surface.
Figure 3:
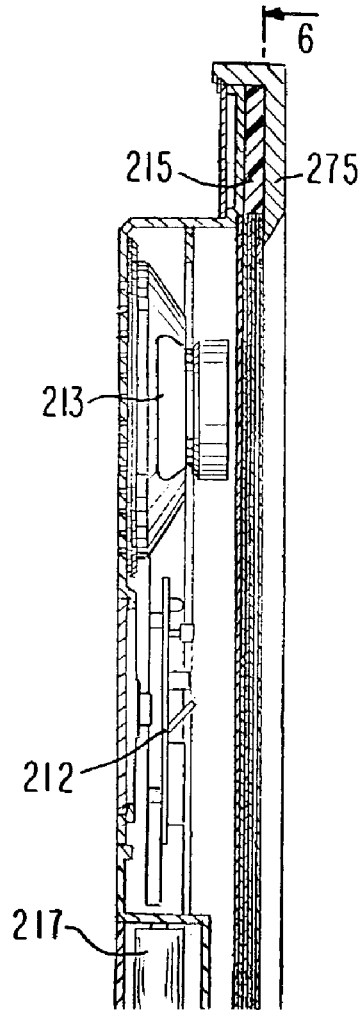
FIG. 3 is a vertical cross-sectional view from the viewpoint of arrows 3 in FIG. 1.
Figure 4:
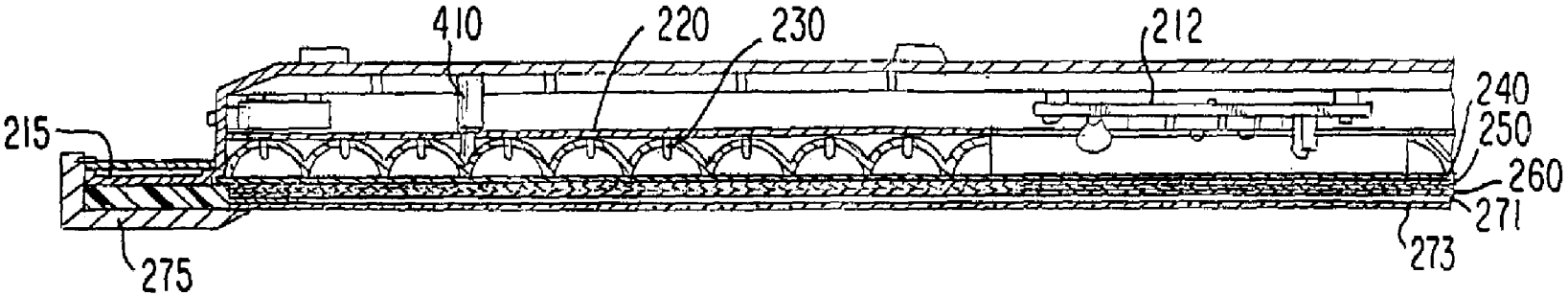
FIG. 4 is a horizontal cross-sectional view from the viewpoint of arrows 4 in FIG.1.
Figure 5:
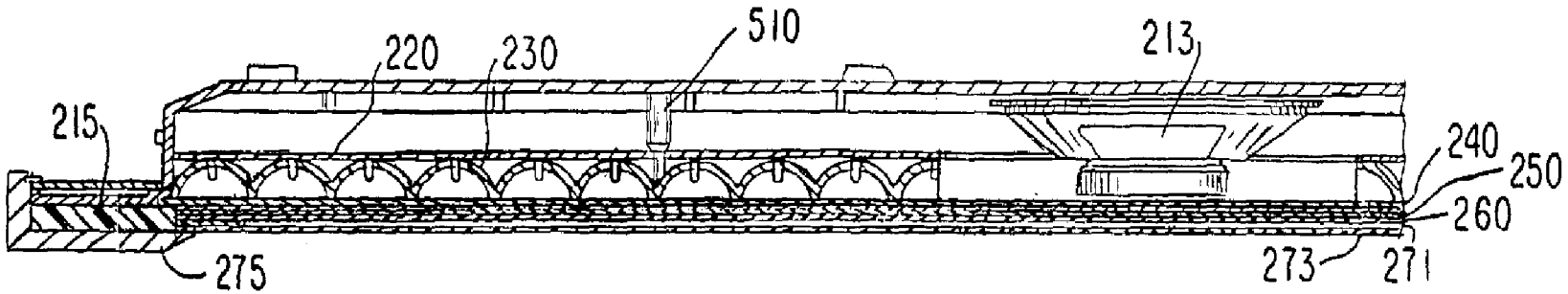
FIG. 5 is a horizontal cross-sectional view from the viewpoint of arrows 5 in FIG. 1.

FIG. 1 is a perspective view of a display device 110 according to the preferred embodiment of the present invention. Display device 110 is hanging by hanging wire 115 on nail 117 which is posted in a vertical surface, such as a wall. Each of the reference numerals 3, 4, and 5 indicate a planar surface as represented by crossed lines, and the direction of a viewpoint on that planar surface as represented by an arrow. The three viewpoints indicated by numerals 3, 4, and 5 are shown in FIGS. 3, 4, and 5, respectively. This same system of crossed lines and an arrow representing a viewpoint taken in another drawing is used throughout the figures.

Figure 2:
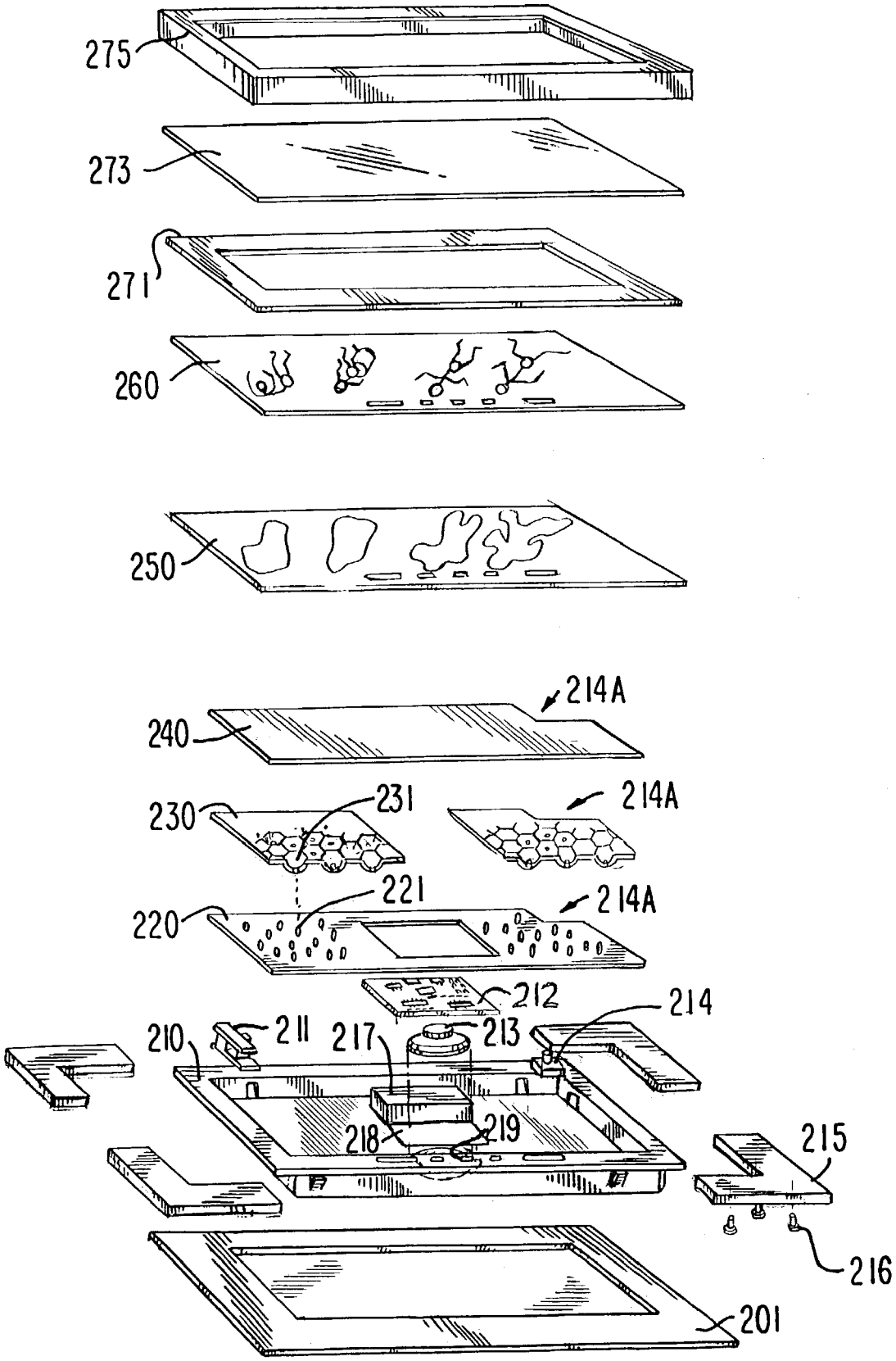
FIG. 2 is an exploded perspective view of the display device according to a preferred embodiment of the present invention.

FIG. 2 is an exploded perspective view of the display device according to a preferred embodiment of the present invention. When fully assembled, a viewer would look at the display device from a viewpoint at the top of the drawing down through the various levels of the device. Plastic Tray 210 has an integrated printed circuit board (PCB) 212 which contains one or more processors (including a Central Processing Unit (CPU)) and control circuitry for the device. Battery Case 217 is located in the center bottom of Tray 210. Batteries are loaded from the back of Tray 210. Under CPU PCB 212 in Tray 210 is Access Panel 218 through which a user may either re-program or replace the CPU. In another embodiment, the CPU is in the form of a FPGA which can be re-programmed through Access Panel 218. In this and other embodiments, the communication connection could be wireless as well as wired.

Speaker 213 and Volume & On/Off switch 211 are connected to CPU PCB 212 and are also secured in Plastic Tray 210. Speaker Grille is located beneath Speaker 213 and above both CPU PCB 212 and Battery Case 217. Motion Detector 214 is secured in the lower corner (as seen by the viewer) of the display device. Mat Supports 215 are snapped onto Tray 210 and give the structure and support necessary to add a mat to the artwork and to allow the finished piece to be easily framed. In the preferred embodiment, each of the Mat Supports 215 are fastened to Tray 210 by three screws 216.

Motion Detector 214 is a proximity type switch that detects the viewer's hand as it passes close to the location of Motion Detector 214. In the preferred embodiment, it is an infrared (IR) system consisting of an emitter (e.g., IR LED such as used in remote controls) and a receiver. Holes 214A are cut through the opaque layers in the area above Motion Detector 214. This is for the Motion Detector 214 be able to send out and receive IR light. However, the layers on top of those three layers with Holes 214A do not have a hole and, thus, the viewer will not see Motion Detector 214. The IR system will read through those upper layers of background art, glass, and other material between Motion Detector 214 and the outside of the display device. This is advantageous in that Motion Detector 214 will be an "invisible" switch, and not disfigure the displayed artwork from its traditional state.

Figure 8:
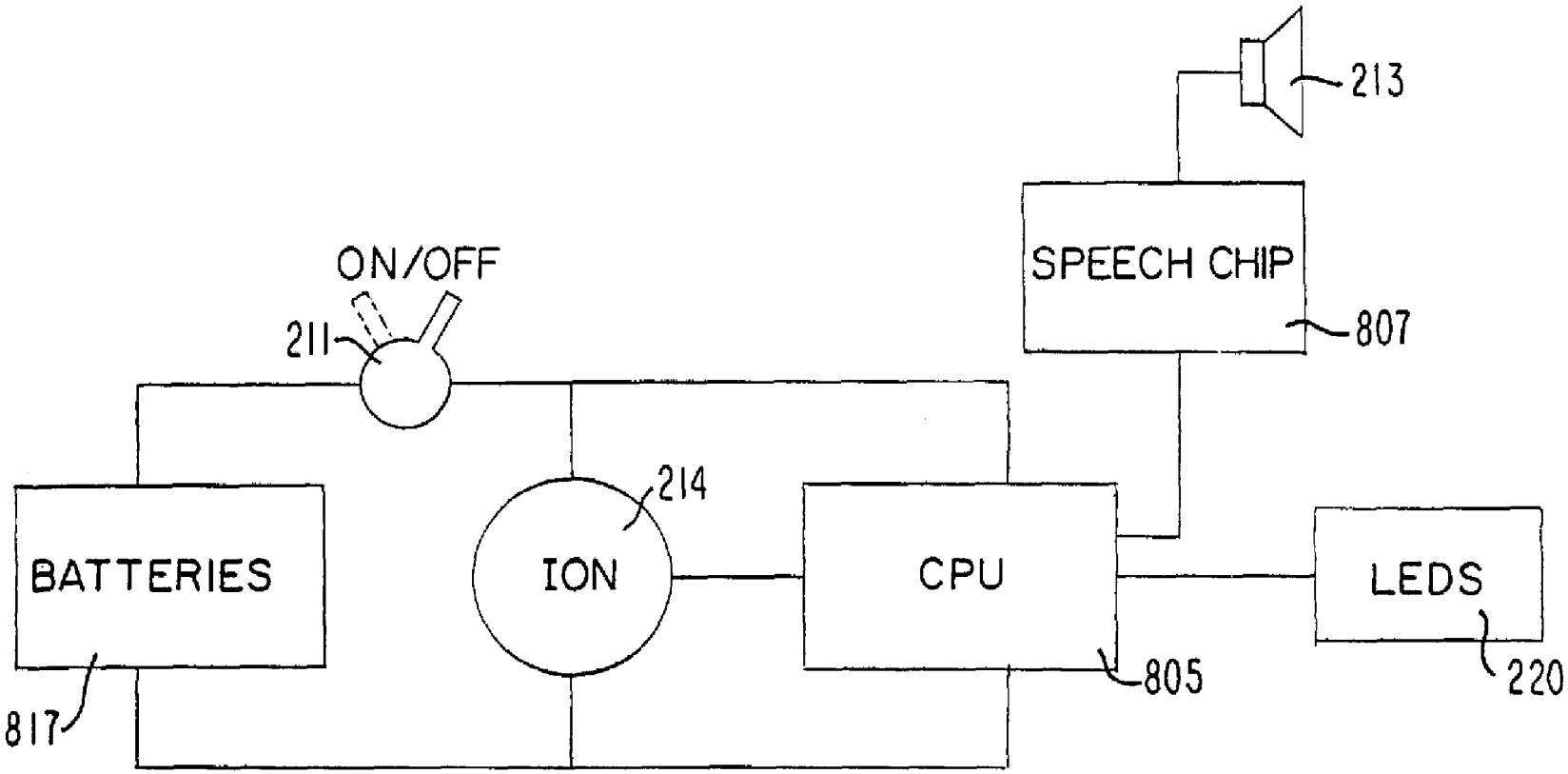
FIG. 8 is a schematic diagram of the electrical components in the display device according to an embodiment of the present invention.

FIG. 8 is a schematic diagram of the electrical components in Display Device 110 according to an embodiment of the present invention. Motion Detector 214 is shown connected to the power supply (Batteries 817), On/Off Switch 211, and CPU 805. CPU 805 controls the functioning of Motion Detector 214, the LEDs in LED PCB 220, and Speaker 213. In order to control Speaker 213, CPU 805 uses Speech Chip 807. In the preferred embodiment, both CPU 805 and Speech Chip 807 are located on CPU PCB 212.

Figure 7:
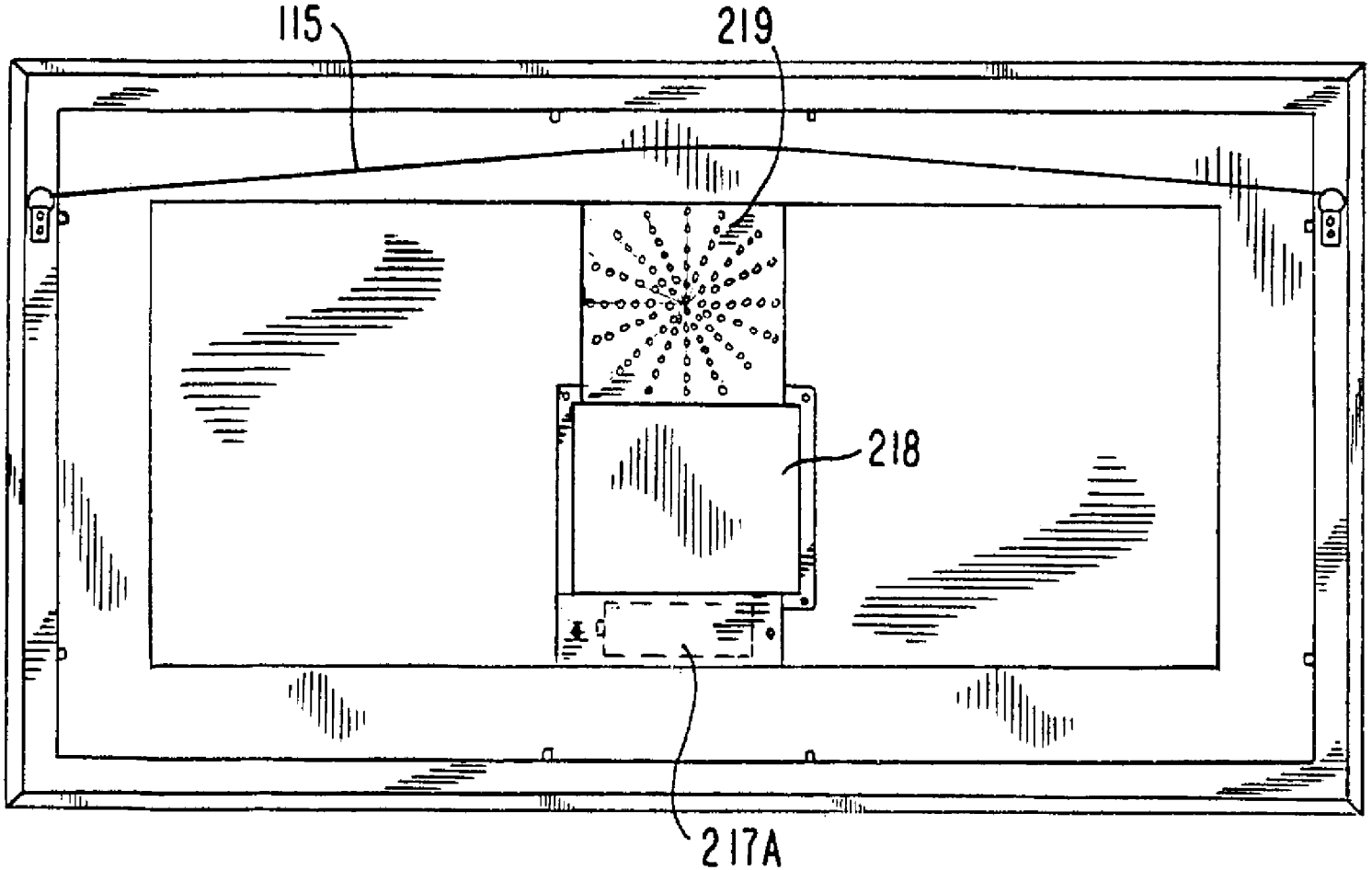
FIG. 7 is a rear view of the display device in one embodiment of the present invention.
Figure 9:
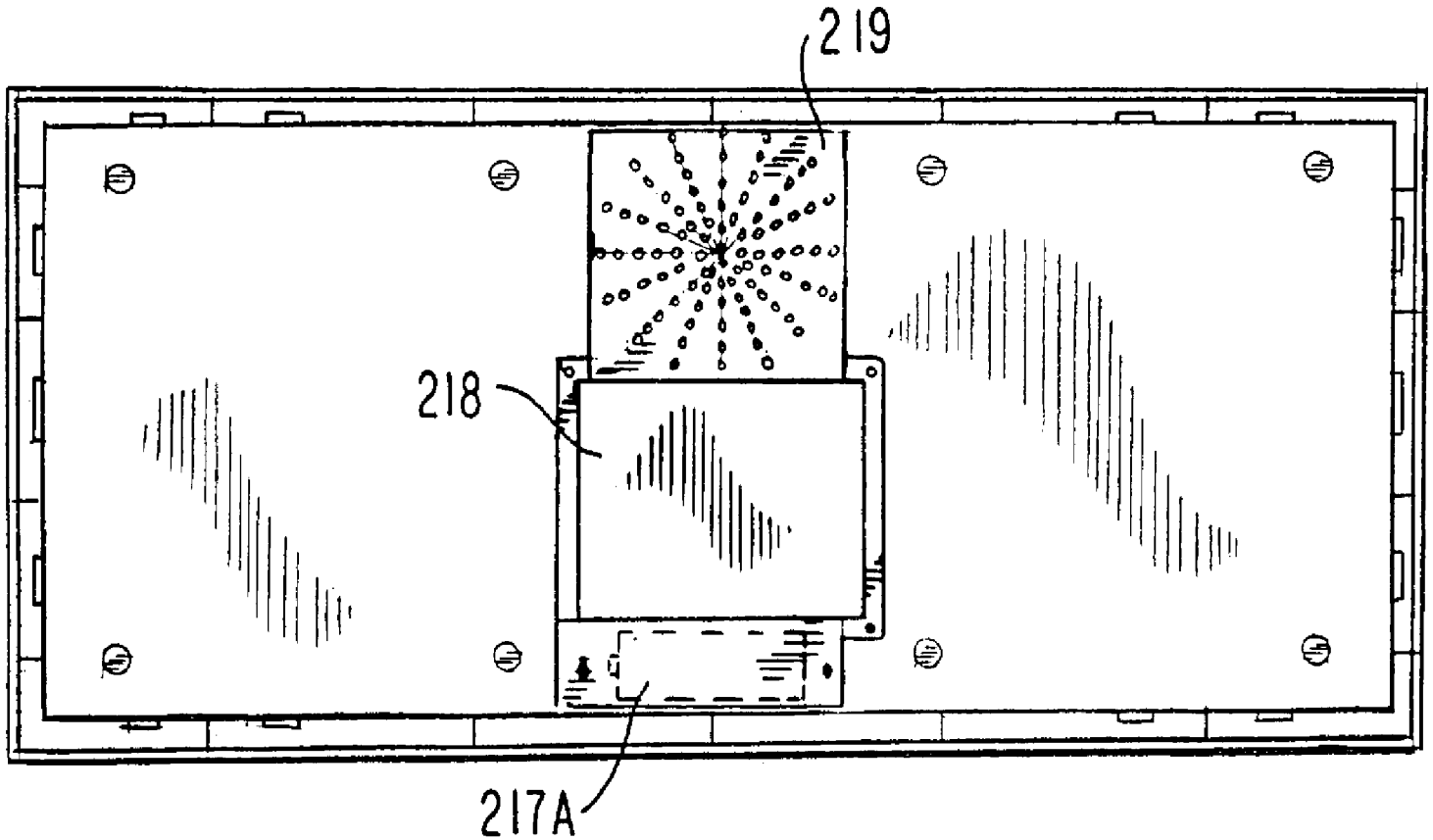
FIG. 9 is a view on the rear of Tray 210 of FIG. 2 according to a preferred embodiment of the present invention.

Under Tray 210, Rear Decorative Mat 201 is attached in order to cover most of the back of Tray 210 and onto which is attached Hanging Wire 115. In the preferred embodiment, the back of Tray 210 appears as shown in FIG. 9. The Speaker Grille 219 is in the center top, under which Access Panel 218 is placed. On the center bottom is located the Battery Cover 217A for installing and removing the batteries in Battery Case 217. FIG. 7 shows the back of Display Device 110 after Rear Decorative Mat 201 has been attached in one embodiment of the invention. PHOTO 3 shows the back of Display Device 110 after Rear Decorative Mat 201 has been attached in another embodiment of the present invention.

Returning to FIG. 2, the first layer to be affixed to Tray 210 is comprised of one or more LED PCBs 220. In FIG. 2, the LED PCB 220 is one solid section. In the preferred embodiment, there are four LED PCBs 220 (not shown) for each of the quadrants making up the layer. Each LED PCB 220 is comprised of an array of LEDs which are individually addressable by the CPU in CPU PCB 212. One or more LEDs is sufficient to illuminate an image, and the CPU will control which LEDs are lit and when. In the preferred embodiment, this is coordinated with a soundtrack. Each generic housing will have an entire array of LEDs, although some or many of them may not be used depending on the image being displayed. The inventive audio-visual display device allows this non-use, or waste, of the light source because of the inexpensive nature of LEDs. The generic housing ensures the universal applicability of the housing for any type of image display within the constraints of the size of the display. In this manner, the manufacturer does not need to create individual housings for particular displays or a particular series of displays, nor does the manufacturer need to program the electronics or fit any particular piece in the display device.

The central area in LED PCB 220 above Speaker 213, CPU PCB 212, and Battery Case 217 is cut out in order that all the components fit. In another embodiment, this layer may be comprised of a complete covering by one or more LED PCBs 220. In addition, the lower right-hand corner of LED PCB 220 shows Hole 214A for Motion Detector 214. Hole 214A is also in the layers above LED PCB 220.

In FIG. 2, Honeycomb Reflector 230 is placed above LED PCB 220 so that each LED 221 in LED PCB 220 fits into a hole in the bottom of each hexagonal reflector 231 in Honeycomb Reflector 230. Because each hole is centered in the bottom of each hexagonal reflector 231, the light from each LED 221 is dispersed by the reflective walls over a wider area. In addition, the reflective walls of each hexagonal reflector 231 prevent light from leaking into adjacent hexagonal reflectors. Honeycomb Reflector 230 in FIG. 2 is in two separate pieces, with the central area on top of Speaker 213, CPU PCB 212, and Battery Case 217 having no Honeycomb Reflector 230. In the preferred embodiment, Honeycomb Reflector 230 is in four separate pieces, or quadrants, completely surrounding a central square above Speaker 213, CPU PCB 212, and Battery Case 217. Depending on the embodiment, the Honeycomb Reflector 230 may be in one or many pieces. Hole 214A above Motion Detector 214 is also in the corner of Honeycomb Reflector 230.

In FIG. 2, the next layer comprises Diffuser 240 which is a translucent plastic sheet that diffuses the light from each honeycomb to create a softer, more diffuse light. Diffuser 240 is secured to Tray 210 so that the unit is sealed and protected from the customer and the environment. Diffuser 240 also has Hole 214A in the corner above Motion Detector 214. In the preferred embodiment, Hole 214A for Motion Detector 214 is smaller than Holes 214 in the layers underneath the Diffuser 240 layer, because Hole 214A is only above the emitter of Motion Detector 214, rather than the entire Motion Detector 214.

The display art is printed and/or silk-screened in two or three layers. Each layer is registered exactly to each other by die cut punch holes. These holes will fit to corresponding projections on the tray so that the light source, i.e., the hexagonal reflectors, matches the image precisely. In the preferred embodiment, the display art is in two layers: Background Art & Light Mask 250 and Cel 260 (in FIG. 2).

Background Art & Light Mask 250 is both printed and lithographed in several layers. The background art images of the final display are lithographed onto the front side of the paper. A white tint is screened to the back of the paper to match the color of the paper on the front side. This white tint does not completely cover the paper, but only those areas where an image does not appear in the displayed artwork. Finally, a black layer is screened to the same areas as the white tint on the back to serve as an opaque mask. The white tint layer may overlap into the image area a little more than the black layer.

In other embodiments, the Background Art & Light Mask 250 may be separated into two layers: a background art layer and a lower light mask layer. The background art layer would be a translucent material, such as paper or acetate, upon which the display images were printed. The lower light mask layer, which would fit underneath the background art layer, could be similar color paper with clear translucent areas matching the areas on the background art layer where the display images are printed. A black layer would be silkscreened to the back of this sheet. Such an embodiment may be easier in cases where a printer that is capable of producing a combined Background Art & Light Mask is not available. Registration in these cases may be done by physically adjusting the pieces of paper during construction.

Background Art & Light Mask 250 is useful if one wishes to have background art, to have hidden images that only appear when backlit, or to enhance the overall aesthetic effect when the display images are backlit. In other embodiments, this layer (or layers) may take a completely different form or may not exist at all.

The next layer for the display art is Cel 260, which contains the display image. In the preferred embodiment, this is a silk-screened image printed on a clear material, such as acetate. In other embodiments, it may be giclee or lithographic. The top three layers of the display device are primarily structural. A Mat 271 frames the artwork, while Cover 273 covers the artwork with a clear acrylic through which the viewer views the artwork. All of these are held in place by Frame Mat 275, the top layer in the display device. In the preferred embodiment, the manufacturer produces large quantities of the Display Device 110 without the top three layers, and then creates audio-visual display devices for particular pieces of cartoon art by attaching the last three layers and programming the microprocessor. As a last step, the retailer, framer, or consumer may individualize the appearance of the display device by choosing the frame and mat of the display device.

Figure 2A:
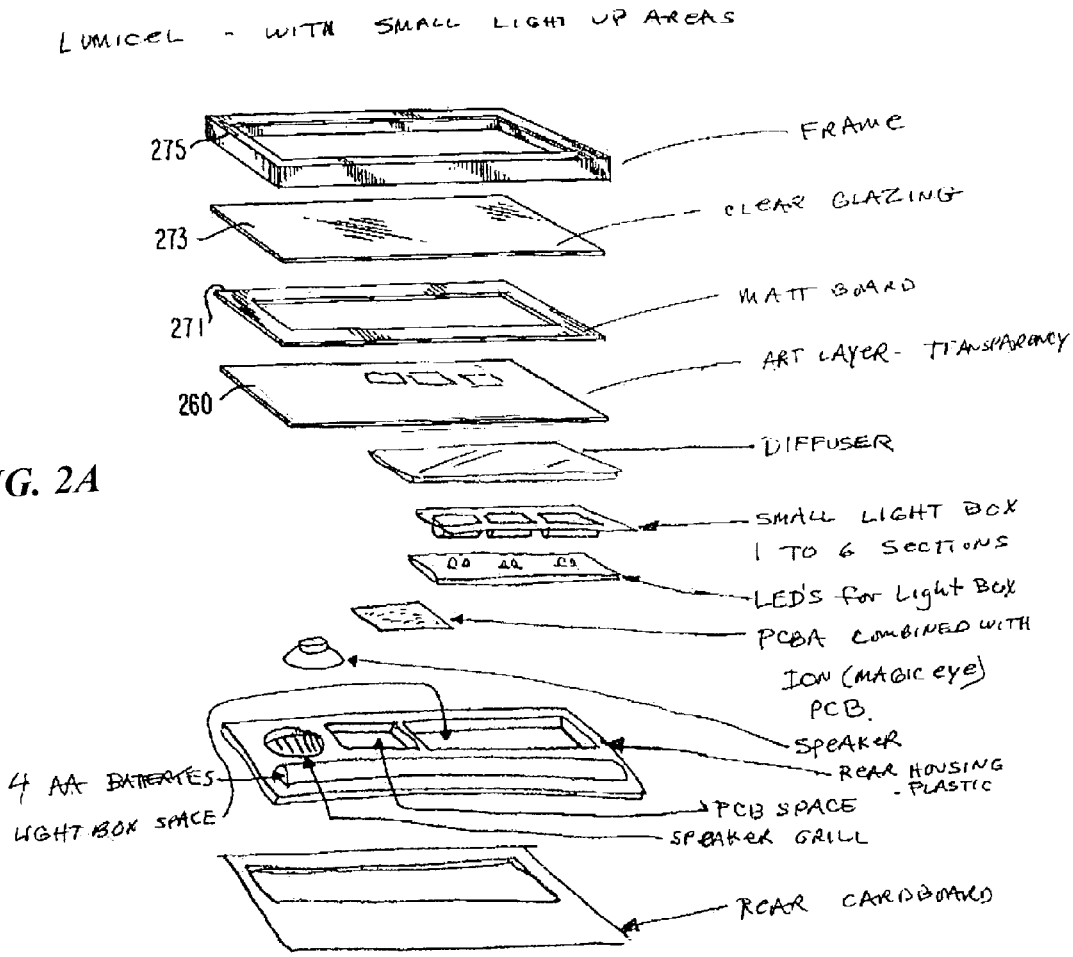
FIG. 2A is an exploded perspective view of the display device according to another preferred embodiment of the present invention.
Figure 2B:
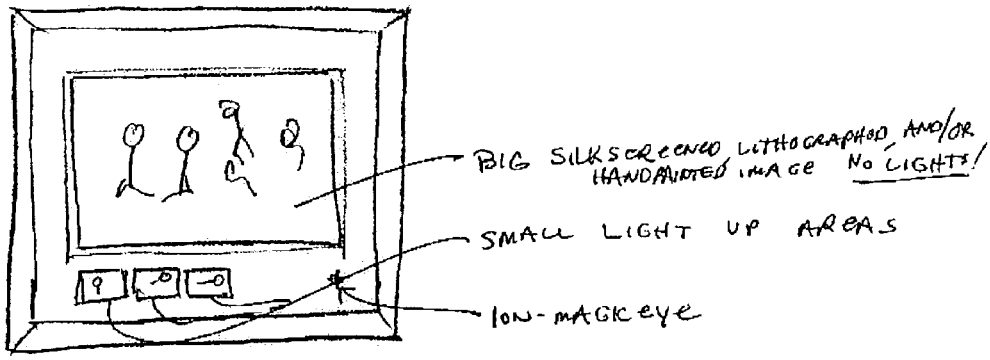
FIG. 2B is a frontal view of the display device according to the preferred embodiment of FIG. 2A.

FIG. 2A is an exploded perspective view of the display device according to another preferred embodiment of the present invention. FIG. 2B shows the display device of FIG. 2A fully assembled. Although the layers in FIG. 2A are mostly the same as FIG. 2, there are some differences. First, there is no Background Art & Light Mask 250, i.e., the diffuser 240 is directly beneath the pictorial artwork 260. Second, only the lower left-hand corner of the pictorial artwork 260 is meant to be lit up, thus Diffuser 240, Honeycomb Reflector 230, and LED PCB 220 in FIG. 2A are smaller and only beneath the lower left-hand corner of the pictorial artwork 260. Third, the placement of Speaker 213, CPU PCB 212, and Battery Case 217 within Tray 210 is completely different than the placement in FIG. 2.

Thus, FIGS. 2A and 2B show some of the variation possible within a rectangular embodiment of the present invention. The layout in FIGS. 2A and 2B does provides at least one advantage over the preferred embodiment in FIG. 2: the majority of pictorial artwork 260 can be made of paper, while only the portions that will be lit up in the lower left-hand corner need to have acetate, film, or another clear material. This can be much less expensive than a pictorial artwork 260 made completely of translucent material. Furthermore, opaque material such as paper is more suitable for particular types of images, such as real images, photographs, or stills from motion pictures. Lithography and glicee work well with such images (on opaque materials), whereas silkscreening works well with cartoon-like images (on clear materials, such as a cell or film).

In rectangular embodiments of the present invention, such as FIGS. 2 and 2A, the width and length of the artwork, backbox, and frame are not limited to any particular ratio of dimensions of the width and length. Furthermore, the present invention is not limited to rectangular embodiments, but may take any shape (e.g., triangular, circular, custommade for a species of artwork, etc.) in which the present invention may be implemented.

FIG. 3 is a vertical cross-sectional view from the viewpoint of arrows 3 in FIG. 1. From this viewpoint, Speaker 213, CPU PCB 212, and Battery Case 217 (with batteries inside) appear in profile. The layers presented in exploded format in FIG. 2 are packed together in presentation format by Frame Mat 275 and Mat Support 215 in FIG. 3.

FIG. 4 is a horizontal cross-sectional view from the viewpoint of arrows 4 in FIG. 1. This is not a complete cross-section, but only shows the center region and the left-hand side. CPU PCB 212, LED PCB 220, and Honeycomb Reflector 230 are shown in this view. A Stand-Off Post 410, which is used as structural support for LED PCB 220 and the layers above it, is also shown. The stand-off posts also serve the purpose of providing a certain amount of distance between Honeycomb Reflector 230 and Diffuser 240. This distance is required in order to insure that no shadows are cast upon Diffuser 240 from the walls between each of the hexagonal cells. In addition, this distance is calculated so that there is a calibrated amount of light leakage in order to get a sufficiently distinct edge to the light.

FIG. 5 is a horizontal cross-sectional view from the viewpoint of arrows 5 in FIG. 1. Similar to FIG. 4, this is not a complete cross-section, but only shows the center region and the left-hand side. Speaker 213, LED PCB 220, and Honeycomb Reflector 230 are shown in this view. A Stand-Off Post 510, which is used as structural support for LED PCB 220 and the layers above it, is also shown. In FIGS. 4 and 5, the various layers 240–273 are labelled.

Figure 6:
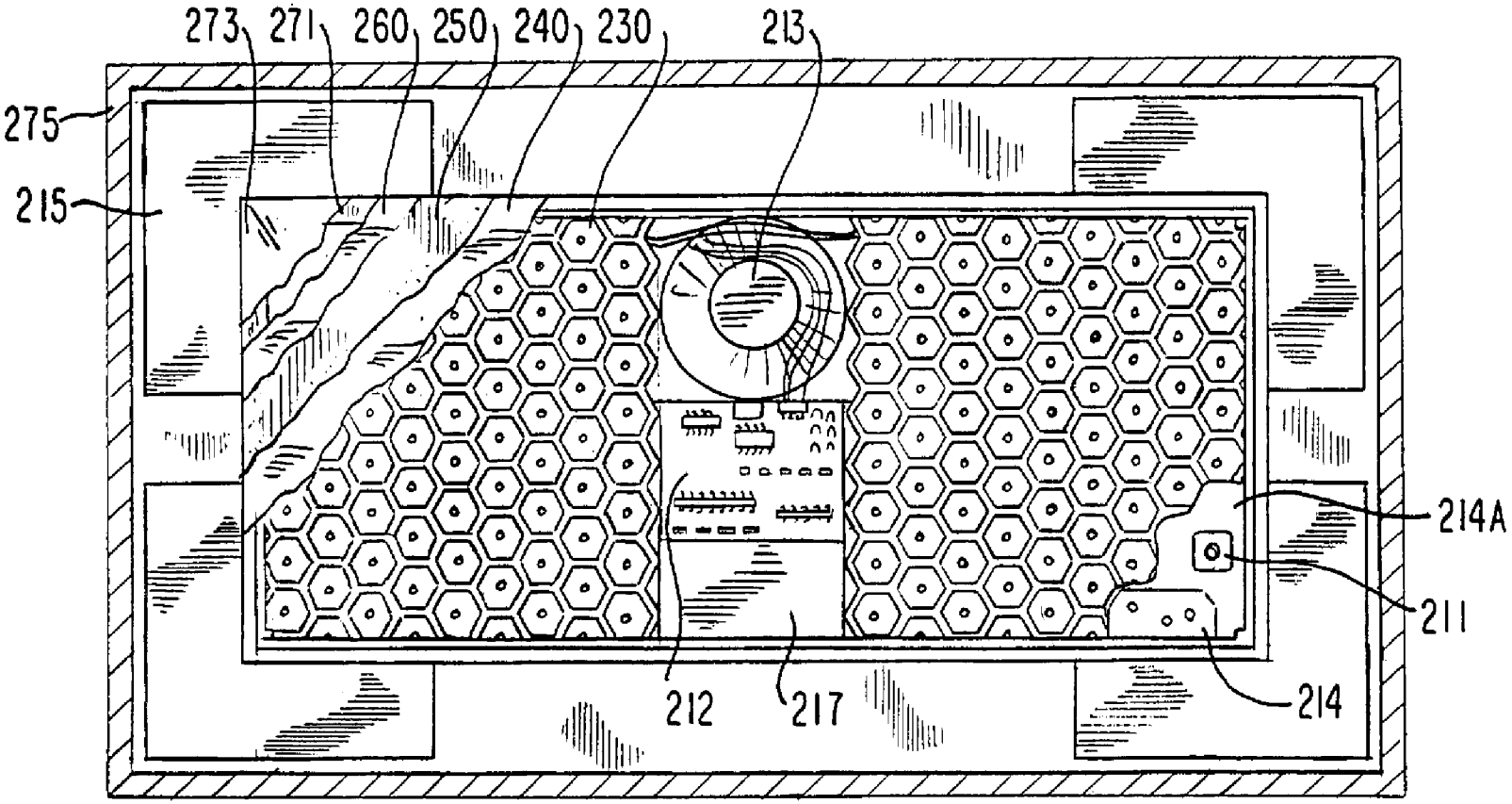
FIG. 6 is a frontal view of the display device from the viewpoint of arrows 6 in FIG. 3.

FIG. 6 is a frontal view of the display device from the viewpoint of arrows 6 in FIG. 3. FIG. 6 shows portions of the various layers cut away in order to see the interior, according to the preferred embodiment of the present invention. At the four corners are Mat Supports 215 inside of Mat Frame 273. The layers, starting from the top-most, are: Cover 273, Mat 271, Cel 260, Background Art & Light Mask 250, Diffuser 240, and Honeycomb Reflector 230. In the center portion are Speaker 213, CPU PCB 212, and Battery Case 217. In the lower left-hand corner, under cutaway portion 214A, are Volume & On/Off Switch 211 and Motion Detector 214.

As shown above, the preferred embodiment of the present invention is a widely flexible generic housing containing electronics, lights, speaker, switches, and structural lighting support. Because of this novel and unique construction, a wide variety of artwork, as presented in Background Art & Light Mask 250 and Cel 260, can be easily placed within the display device and a wide variety of audio-visual tracks, as easily re-programmed in CPU PCB 212, can be presented in conjunction with the artwork.

One particular use of the present invention is the display of a "model sheet" or an artwork much like a model sheet. A model sheet contains the exemplary poses and stances of a cartoon character, and is used by the animators when creating individual frames of a sequence. Thus, a model sheet of Mickey Mouse would have multiple images of Mickey in various poses or costumes, such as Mickey walking, running, sitting, or waving a wand in a wizard's costume. The present invention would be used to light each of the various poses and provide an audio track from a movie or cartoon appropriate to the lighted pose. In addition to the dedicated poses with particular corresponding snippets, certain images which, when unlit, are not discernible to the eye may be in the artwork. These hidden images (and associated snippets) add to the expressive nature of artworks displayed by the present invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A electronic display device comprising:

a housing;

a lightboard removably attached to said housing, said lightboard comprising a reflector having a plurality of light sockets, wherein a light source is located in at least one light socket;

at least one processor located in said housing, said at least one processor for controlling the light sources in said lightboard; and a sensor located in the housing, said sensor for detecting at least one of an object or motion within a certain range of said sensor, wherein the at least one processor is connected to said sensor and receives a signal from said sensor when at least one of an object or motion is detected;

wherein said housing is configured to allow a pictorial artwork to be removably attached to said housing above said lightboard, whereby at least one section of the pictorial artwork is lit up by one or more light sources located in light sockets directly beneath the at least one section without substantially lighting other sections of the pictorial artwork; and wherein said at least one processor is uniquely programmed to control the light sources in said lightboard in a manner appropriate to whichever pictorial artwork is attached to said housing.

2. The electronic display device of claim 1, wherein the shape of each of the plural light sockets is one of an oval, a circle, and a polygon.

3. The electronic display device of claim 1, wherein the reflector is a honeycomb reflector, and each of the plural light sockets has a hexagonal shape.

4. The electronic display device of claim 1, wherein at least one light source is a Light Emitting Diode (LED).

5. The electronic display device of claim 1, wherein at least one light source produces a light which, when lit, causes a slight change in color of the pictorial artwork paper directly above the lit at least one light source.

6. The electronic display device of claim 5, wherein the produced light comprises a substantially yellow light having a wavelength substantially around 595 nm.

7. The electronic display device of claim 1, wherein the pictorial artwork is cartoon art.

8. The electronic display device of claim 1, wherein at least a section of the pictorial artwork is viewable when no light source in the lightboard is illuminated.

9. The electronic display device of claim 1, further comprising:

a speaker located in the housing;

wherein the at least one processor controls said speaker.

10. The electronic display device of claim 9, wherein at least one audio-visual sequence is programmed into the at least one processor, and wherein, in said at least one audio-visual sequence, at least one section of the pictorial artwork is lit by at least one light source in the lightboard while sound corresponding to said at least one section is reproduced by the speaker.

11. The electronic display device of claim 9, further comprising:

a memory located in the housing, said memory for storing at least one audio sequence;

wherein the at least one processor controls said memory and provides the at least one audio sequence to the speaker for reproduction.

12. The electronic display device of claim 1, wherein the sensor is an infrared (IR) system comprised of an emitter and a receiver.

13. The electronic display device of claim 1, wherein, when the pictorial artwork is attached to the housing, the sensor is thereby hidden from view.

14. The electronic display device of claim 1, wherein the certain range of the sensor is an area substantially close to the location of the sensor in the housing.

15. The electronic display device of claim 1, wherein the certain range of the sensor is within about six to about twelve inches of the location of the sensor in the housing.

16. An electronic display device, comprising:

a housing;

a lightboard removably attached to said housing, said lightboard comprising a reflector having a plurality of light sockets, wherein a light source is located in at least one light socket; and at least one processor located in said housing, said at least one processor for controlling the light sources in said lightboard;

wherein said housing is configured to allow a pictorial artwork to be removably attached to said housing above said lightboard, whereby at least one section of the pictorial artwork is lit up by one or more light sources located in light sockets directly beneath the at least one section without substantially lighting other sections of the pictorial artwork;

wherein said al least one processor is uniquely programmed to control the light sources in said lightboard in a manner appropriate to whichever pictorial artwork is attached to said housing; and wherein at least one light source is controllable by the at least one processor independently from the remaining light sources.

17. The electronic display device of claim 16, wherein each light source is independently controllable by the at least one processor.

18. An electronic display device comprising:

a housing;

a lightboard removably attached to said housing, said lightboard comprising a reflector having a plurality of light sockets, wherein a plurality of light sources are located in the plural light sockets;

a speaker located in said housing;

a sensor located in said housing, said sensor for detecting at least one of an object or motion within a certain range of said sensor; and at least one processor located in said housing, said at least one processor for controlling the speaker and at least one light source of the plural light sources in said lightboard, wherein the at least one light source is controllable independently from the remaining light sources of the plural light sources, and wherein said at least one processor receives a signal from said sensor when at least one of an object or motion is detected;

wherein said housing is configured to allow a pictorial artwork to be removably attached to said housing above said lightboard, whereby at least one section of the pictorial artwork is lit up by one or more light sources located in light sockets directly beneath the at least one section without substantially lighting other sections of the pictorial artwork; and wherein at least one audio-visual sequence is programmed into the at least one processor and activated when said at least one processor receives the signal from said sensor, and wherein, in said at least one audio-visual sequence, at least one section of the pictorial artwork is lit by at least one light source in the lightboard while sound corresponding to said at least one section is reproduced by the speaker.

19. The electronic display device of claim 18, wherein the shape of each of the plural light sockets is one of an oval, a circle, and a polygon.

20. The electronic display device of claim 18, wherein the reflector is a honeycomb reflector, and each of the plural light sockets has a hexagonal shape.

21. The electronic display device of claim 18, wherein at least a section of the pictorial artwork is visible when no light source in the lightboard is illuminated.

22. The electronic display device of claim 18, wherein a plurality of snippets are programmed into the at least one processor, where a snippet is a discrete audio-visual sequence.

23. The electronic display device of claim 22, wherein, each time the at least one processor receives a signal from the sensor, one single snippet is activated.

24. The electronic display device of claim 23, wherein the plural snippets are in a particular order, and wherein the one single snippet activated is the next snippet in order after the last snippet played.

25. The electronic display device of claim 23, wherein the one single snippet activated is randomly chosen from the plural snippets.

26. The electronic display device of claim 22, wherein the sensor is for detecting an object and the sensor sends a signal to the at least one processor corresponding to the length of time an object is within the certain range of the sensor.

27. The electronic display device of claim 26, wherein a number of snippets sequentially activated depends on the length of time an object is detected within the certain range of the sensor.

28. The electronic display device of claim 27, wherein the plural snippets are in a particular order, and wherein the sequentially activated snippets follow the particular order.

29. The electronic display device of claim 26, wherein the sequentially activated snippets are randomly chosen from the plural snippets.

30. The electronic display device of claim 18, wherein the at least one processor is removably attached to the housing, whereby the at least one processor may be replaced with another at least one processor into which another at least one audio-visual sequence has been programmed.

31. The electronic display device of claim 18, wherein the at least one processor is re-programmable, whereby the at least one audio-visual sequence may be replaced with another at least one audio-visual sequence.

32. The electronic display device of claim 18, wherein the at least one processor comprises:

a field programmable gate array (FPGA).

33. The electronic display device of claim 18, further comprising:

a light mask layer between the pictorial art work and the lightboard, said light mask layer having transparent portions substantially aligned with image sections of the pictorial artwork and opaque portions substantially aligned with sections of the pictorial artwork without images.

34. The electronic display device of claim 18, further comprising:

a background art layer between the pictorial art work and the lightboard, said background art layer being a translucent layer having background art images.

35. The electronic display device of claim 34, wherein at least one of the background art images is not substantially visible when not backlit.

36. The electronic display device of claim 18, further comprising:

a combination background art and light mask layer between the pictorial art work and the lightboard, said combination background art and light mask layer having background art images on first transparent portions, wherein image sections of the pictorial artwork are substantially aligned with second transparent portions of said combination background art and light mask layer, and wherein sections of the pictorial artwork without images are substantially aligned with opaque portions of said combination background art and light mask layer.

37. The electronic display device of claim 18, wherein die cut punch holes in the pictorial artwork are used to align the pictorial artwork with the lightboard underneath.

38. The electronic display device of claim 18, further comprising:

at least one printed circuit board (PCB) having an array of light emitting diodes (LEDs), wherein the LEDs comprise the at least one light source in the lightboard.

39. The electronic display device of claim 18, further comprising:

a diffuser placed between the pictorial artwork and the lightboard.

40. The electronic display device of claim 18, further comprising:

at least one printed circuit board (PCB) containing the at least one processor.

41. A method of providing an electronic display device comprising the steps of:

manufacturing a housing;

manufacturing a lightboard which can be removably attached to said housing, said lightboard comprising a reflector having a plurality of light sockets, wherein a light source is located in at least one light socket; and providing at least one processor, said at least one processor for controlling the light sources in said lightboard;

providing a sensor located in the housing, said sensor for detecting at least one of an object or motion within a certain range of said sensor, wherein the at least one processor is connected to said sensor and receives a signal from said sensor when at least one of an object or motion is detected;

wherein said housing is configured to allow a pictorial artwork to be removably attached to said housing above said lightboard, whereby at least one section of the pictorial artwork is lit up by one or more light sources located in light sockets directly beneath the at least one section without substantially lighting other sections of the pictorial artwork; and wherein said at least one processor is uniquely programmed to control the light sources in said lightboard in a manner appropriate to whichever pictorial artwork is attached to said housing.

42. The method of claim 41, wherein the shape of each of the plural light sockets is one of an oval, a circle, and a polygon.

43. The method of claim 41, wherein the reflector is a honeycomb reflector, and each of the plural light sockets has a hexagonal shape.

44. A method of assembling an electronic display device comprising the step of:

assembling a universal backbox, said universal backbox comprising:

a housing;

a lightboard removably attached to said housing, said lightboard comprising a reflector having a plurality of light sockets, wherein a light source is located in at least one light socket; and at least one processor located in said housing, said at least one processor for controlling the light sources in said lightboard;

a sensor located in the housing, said sensor for detecting at least one of an object or motion within a certain range of said sensor, wherein the at least one processor is connected to said sensor and receives a signal from said sensor when at least one of an object or motion is detected;

wherein said universal backbox is configured to allow a pictorial artwork to be removably attached to said universal backbox above said lightboard, whereby at least one section of the pictorial artwork is lit up by one or more light sources located in light sockets directly beneath the at least one section without substantially lighting other sections of the pictorial artwork; and wherein said at least one processor is uniquely programmed to control the light sources in said lightboard in a manner appropriate to whichever pictorial artwork is attached to said housing.

45. The method of claim 44, wherein the shape of each of the plural light sockets is one of an oval, a circle, and a polygon.

46. The method of claim 44, wherein the reflector is a honeycomb reflector, and each of the plural light sockets has a hexagonal shape.

47. The method of claim 44, further comprising the step of:

programming the at least one processor with at least one visual sequence, wherein at least one section of the pictorial artwork is lit by at least one light source in the lightboard during the at least one visual sequence.

48. The method of claim 44, further comprising the step of:

programming the at least one processor with at least one audio-visual sequence, wherein, during the audio-visual sequence, at least one section of the pictorial artwork is lit by at least one light source in the lightboard while sound corresponding to said at least one section is reproduced by a speaker.

49. The electronic display device of claim 44, wherein the assembling step further comprises the step of:

attaching a diffuser above the lightboard.

50. The method of claim 44, further comprising the step of:

sending the assembled universal backbox to a retailer.

51. The method of claim 44, further comprising the step of:

attaching pictorial artwork to the assembled universal backbox.

52. The method of claim 51, further comprising the step of:

framing the pictorial artwork and assembled universal backbox.

* * * * *